United States Patent [19]

Frechette

[11] 4,046,245

[45] Sept. 6, 1977

[54] CARRIAGE STABILIZATION MEANS FOR A SERIAL PRINTER

[75] Inventor: Kenneth R. Frechette, Dallas, Tex.

[73] Assignee: Xerox Corporation, Stamford, Conn.

[21] Appl. No.: 640,125

[22] Filed: Dec. 12, 1975

[51] Int. Cl.[2] ..... B41J 19/00

[52] U.S. Cl. ..... 197/60; 197/54; 197/82

[58] Field of Search ..... 197/1 R, 16, 18, 48, 197/49, 50, 51, 52, 53, 54, 55, 60, 69, 82, 84 R, 151

[56] References Cited

U.S. PATENT DOCUMENTS

| | | | |
|---|---|---|---|
| 770,434 | 9/1904 | Kitzmiller | 197/69 X |
| 1,693,144 | 11/1928 | Helmond | 197/69 |
| 2,538,686 | 1/1951 | Hart | 197/69 |
| 3,356,199 | 12/1967 | Robinson | 197/54 |
| 3,400,798 | 9/1968 | Smith | 197/1 R |
| 3,422,945 | 1/1969 | Bethune | 197/53 X |
| 3,448,844 | 6/1969 | Gassino et al. | 197/18 X |
| 3,625,331 | 12/1971 | Waldenburger | 197/55 X |
| 3,731,781 | 5/1973 | Caudill et al. | 197/151 |
| 3,793,951 | 2/1974 | Denley | 197/151 X |
| 3,837,457 | 9/1974 | Anglin et al. | 197/18 |
| B 284,297 | 1/1975 | Bowdle et al. | 197/54 |

*Primary Examiner*—Ernest T. Wright, Jr.

[57] ABSTRACT

A stabilization means for reducing the position excursions of the carriage of a serial impact printer during the printing operation. The stabilization means comprises at least two support members with at least one support member being mounted to each side of the carriage at a point above the carriage pivot point and extending downwardly and outwardly to at least one of the carriage mounting rails.

5 Claims, 7 Drawing Figures

CARRIAGE STABILIZATION MEANS FOR A SERIAL PRINTER

BACKGROUND OF THE INVENTION

This invention relates in general to impact printers and more particularly to the means for stabilizing the carriage during the printing operation of the printer.

The Diablo Corporation, a subsidiary of the present assignee, is marketing a serial printer under the tradename of Diablo Hytype I which employs a movable carriage with a daisy-type print wheel, print hammer and ribbon cartridge mounted thereon. A printer of this type is disclosed in U.S. Pat. No. 3,954,163 which issued from U.S. patent application, Ser. No. 505,105, which is a continuation of a U.S. patent application filed Sept. 4, 1973, in the name of Andrew Gabor, Ser. No. 394,072, entitled "High Speed Printer and Intermittent Printer Wheel with Carriage Movement", now abandoned being a continuation of an application filed Feb. 25, 1972, Ser. No. 229,314, now abandoned, the disclosure of which is incorporated by reference into this specification.

The Diablo Hytype I printer is enjoying commercial success as a serial printer in such applications as communication terminals, computer output devices, etc. However, in certain type applications, such as automatic text-editing typewriter applications in the office environment, additional features and capabilities are desired, e.g., higher print quality. In the text-editing or office-typing environment, the demands for high print quality cause the print wheel to be subjected to about ten times greater force due to about five times greater hammer energy compared to a Hytype I printer operating as a computer output terminal, for example. To provide the high print quality needed, the integrally molded thermoplastic print wheel of the Hytype I printer was replaced by a composite print wheel, such as that disclosed in a copending U.S. patent application, Ser. No. 683,977, being a continuation of an application filed Sept. 25, 1974, in the name of Gordon Sohl et al. Ser. No. 509,193, now abandoned. In addition, a different print hammer assembly was incorporated therein which provided greater hammer energy. A card guide was added to the carriage to provide assistance in the operation of inserting and aligning paper in the automatic text- editing typewriter. The noted changes and additions resulted in an increase of the mass of the carriage. One problem with this type of carriage, because of the geometry of the carriage (high mass center of the structure), is the resulting error in the horizontal alignment or positioning of the printed characters on the record medium. The horizontal alignment or positioning of the printed characters on the record medium exceeded the competitive print quality specification by about ±0.002 inch in the manual typing mode and about ±0.008 inch in the automatic typing mode. The predominate cause of the problem is the movement of the carriage during print time (i.e., when the character slug of the print wheel strikes the platen with reference to the start of hammer fire pulse).

Accordingly, it is a primary object of the present invention to provide an economical method and apparatus for reducing the horizontal alignment error of the printed characters in document creation equipment employing a print wheel impact printer along the presently described vane.

Another object of this invention is to provide a simple and reliable means to reduce the horizontal alignment error of the printed characters, which is compatible with the existing carriage and which may be implemented without significantly increasing the bulk and complexity of the carriage.

Other objects and advantages will be evident from the specification and claims when read in conjunction with the accompanying drawing illustrative of the invention.

SUMMARY OF THE INVENTION

In accordance with the principles illustrative of this invention, the foregoing objects and others of the present invention are accomplished by the provision of stabilization means for the carriage. The stabilization means comprises at least two support members with at least one support member being mounted to each side (right and left as viewed by the operator) of the carriage at a point above the carriage pivot point and extending downwardly and outwardly to at least one of the carriage mounting rails, preferably the forward (as viewed by the operator) rail. A right-angle portion is formed on the lower extension of each support member, with the right- angle extension being parallel to a plane formed by a horizontal tangent to the carriage mounting rail. Attached to the right-angle extension is a layer of teflon impregnated "Delrin" resin which contacts the carriage mounting rail and provides minimum sliding resistance to the lateral movement of the carriage along the carriage mounting rails. The support members reduce the horizontal positioning errors of the printed characters by reducing the oscillations or movements of the carriage during print time by the support provided between the upper portion of the carriage to the carriage mounting rails.

BRIEF DESCRIPTION OF THE DRAWING

Other advantages and features of the present invention may become more apparent from reading the following detailed description in connection with the drawing forming a part thereof in which.

DESCRIPTION OF THE PREFERRED EMBODIMENT

Figure 1:
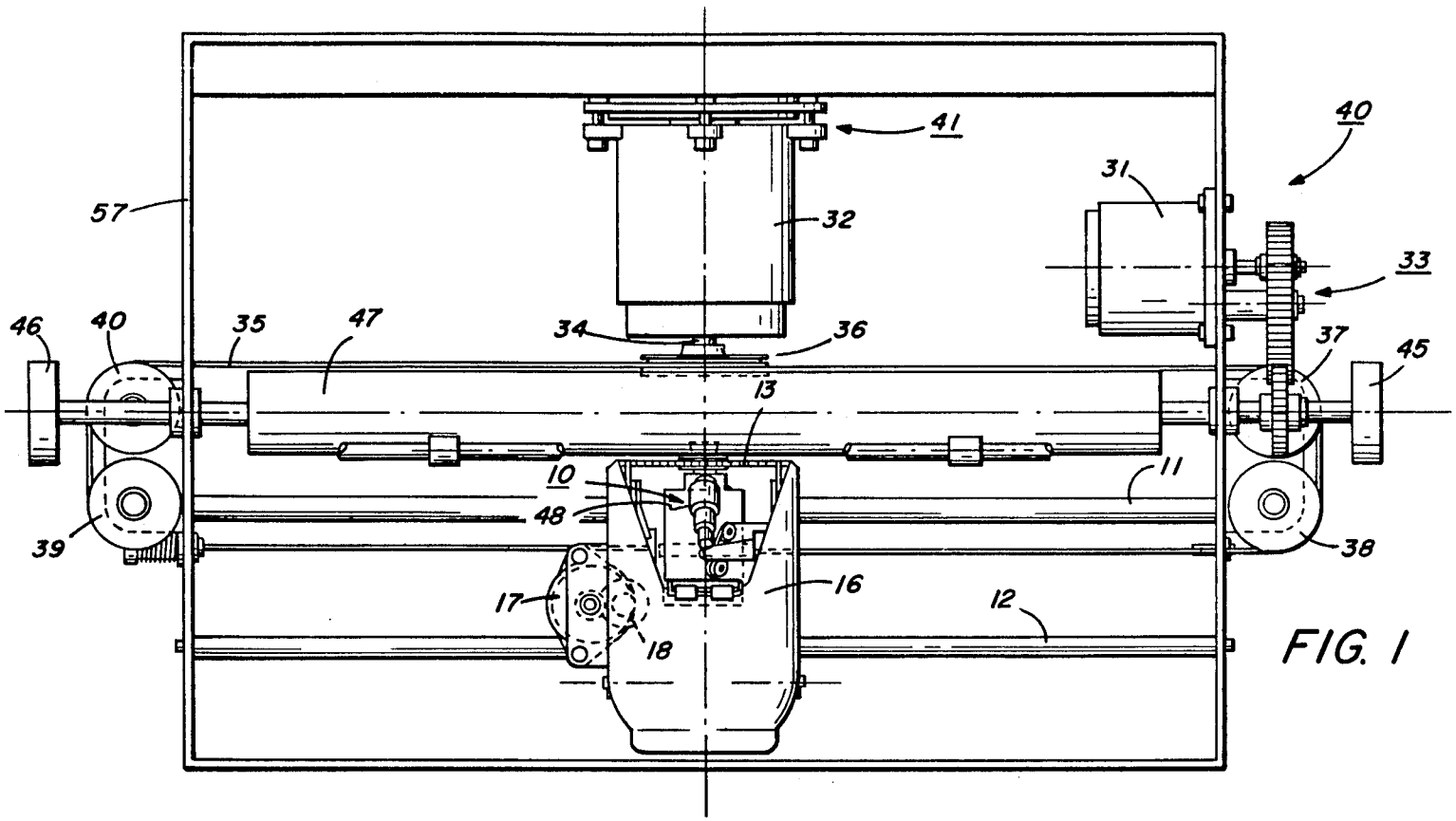
FIG. 1 is a top plan view of a printer embodying the present invention.

Referring now to the drawing and more particularly to FIG. 1, an overall view of the printer 40 embodying the present invention is illustrated. Mounted on a base frame 57 is a platen 47 with knobs 45 and 46 for rolling the platen 47 and the paper record medium (not shown) wrapped thereon. A carriage 10 is mounted for linear movement on the carriage mounting rails 11 and 12 bridged between opposed sidewalls of the base frame 57 of the printer 40. Carriage 10 includes a rotary print wheel 13 on which are a number of type elements or character slugs, a hammer-type impact printing mechanism 48 for striking a selected type element, a ribbon cartridge 16 having an inked ribbon (not shown) interposed between the paper on the platen 47 and the type element on the print wheel 13 located at the print position or station.

Furthermore, there are a stepping motor 31 and a servomotor 32 mounted on the base frame 57. The stepping motor 31 is coupled to the platen 47 by a gear train 33 so that the platen 47 is indexed when the motor 31 is activated to incrementally advance the paper through the printer 40. The servomotor 32, on the other hand, has one end of its drive shaft 34 coupled to the carriage 10 by a cable 35, which is trained around a series of pulleys 36-40, and the other end of its drive shaft 34 coupled to a shaft encoder 41. Thus, the carriage 10 is moved to translate the printing mechanism 48 lengthwise of the platen 47 when the servomotor 32 is actuated, while the encoder 41 supplies a signal which is representative of the actual position of the carriage 10 at any given time.

Figure 2:
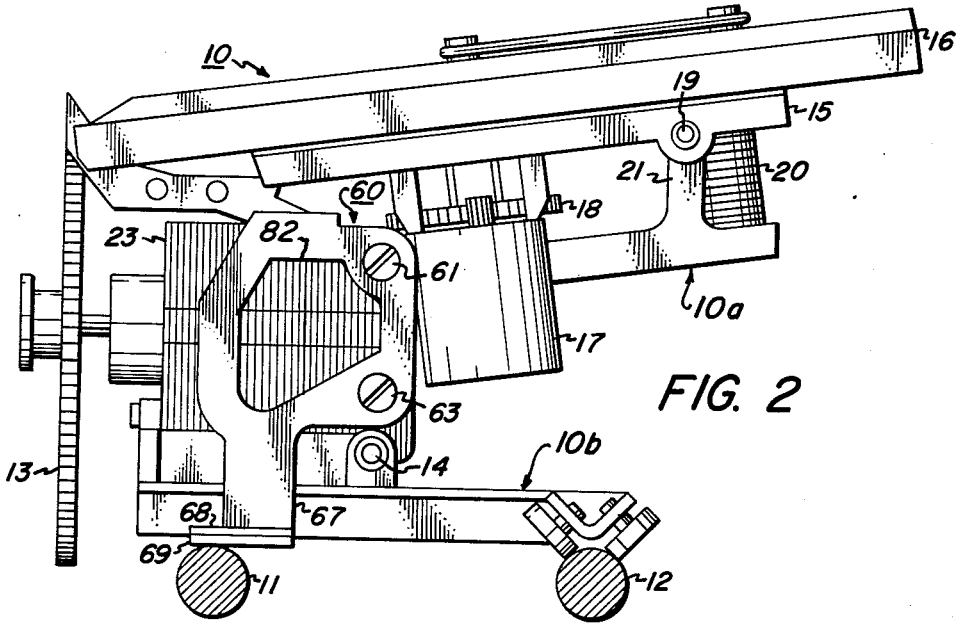
FIG. 2 is a side plan view of the carriage of the printer of FIG. 1 embodying the present invention.
Figure 3:
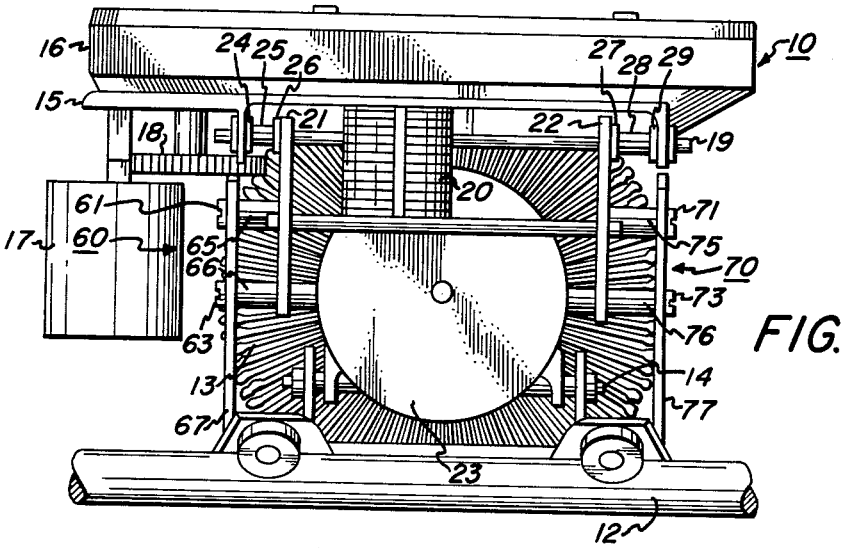
FIG. 3 is a rear plan view of FIG. 2.
Figure 4A:
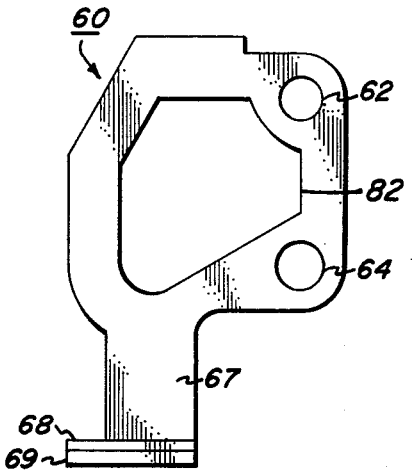
FIGS. 4A and 4B are a plan view of a carriage stabilization means according to the present invention.
Figure 4B:
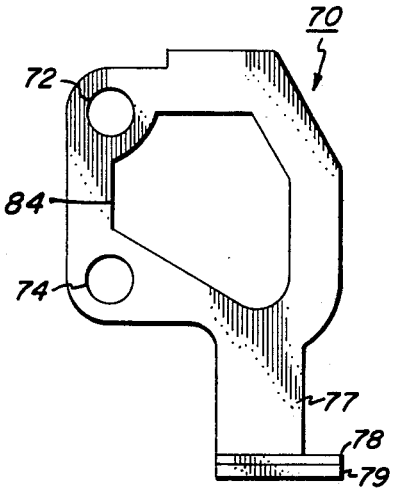
Figure 5A:
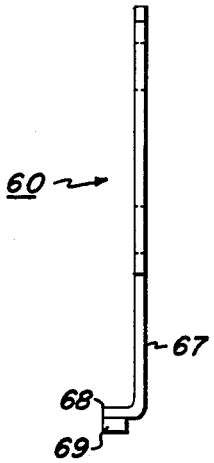
FIGS. 5A and 5B are a side view of FIGS. 4A and 4B.
Figure 5B:
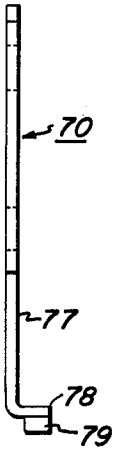

With reference to FIGS. 1 and 2 and the printer carriage 10 mounted for linear movement on the mounting rails 11 and 12, as typing of the printed characters occurs, the carriage 10 stops each time a character is to be printed. Also, while the carriage 10 is moving from one location to the next location along rails 11 and 12 by movement of cable 35, the print wheel 13 is rotated such that the next character to be printed will be in position at the print position or station when the carriage 10 stops and the printing mechanism 48 is fired. As seen in FIG. 2, the upper section 10*a* of carriage 10 is pivotable clockwise about shaft 14 with respect to the lower section 10*b* of carriage 10. This pivoting motion is necessary in order to bring the print wheel 13 up into a position such that the print wheel 13 may be exchanged for a different print wheel 13.

The ribbon cartridge mounting plate 15 provides the mounting structure for the ribbon cartridge 16, the ribbon advance motor 17 and the ribbon advance gearing 18. The ribbon cartridge mounting plate 15 is pivotable clockwise, in FIG. 2, about shaft 19. This pivoting motion is necessary to raise the ribbon from the down position, which is the position that allows the printed material to be viewed by the typist, to the up position at the print station when printing is to occur. The force to pivot the ribbon cartridge mounting plate 15 is a magnetic force supplied by electromagnet coils 20. When coils 20 are energized, that portion of the ribbon cartridge mounting plate 15 above coils 20 is drawn down toward the coils 20 thereby raising that portion of the ribbon cartridge 16 which is nearest the print wheel 13 to the print position.

During the manual mode of operation of the automatic text-editing typewriter, the typist enters character information into the memory and/or creates a printed copy on the typewriter printer 40 at speeds ranging from about 0.5 to 2.0 characters per second (cps). The typed information is manipulated by the electronics to arrange format etc., and an edited document is typed by the printer 40, in the automatic mode under the control of the electronics at speeds ranging from about 20 to 30 cps. It is readily appreciated that the carriage 10 and the print wheel 13 may be and usually are required to start and stop up to 20 to 30 times a second.

The rapid starting and stopping of the cartridge 10 and the print wheel 13 during the printing operation sets up dynamic oscillations in the carriage 10. The coupling means 24-29 between the ribbon cartridge mounting plate 15 and the ribbon cartridge support brackets 21 and 22 of the upper section 10*a* of carriage 10 causes the ribbon cartridge 16, the ribbon advance motor 17, the ribbon advance gearing 18 and the ribbon cartridge mounting plate 15 to amplify the vibrations or oscillations of the remaining parts of the carriage 10 during the rapid starting and stopping movement thereof. The major contributors to the vibrations or oscillations are the mounting means of the carriage 10 to the carriage mounting rails 11 and 12 and the two pivotal mountings noted supra. The amplification of the vibrations or oscillations is due primarily to the geometry of the carriage 10 (the high mass center of the carriage 10) and to a close matching of the vibration frequency of the ribbon cartridge mounting plate 15 and the components mounted thereon to the mounting system frequency of the carriage 10 and the carriage mounting to rails 11 and 12. The above-noted information resulted from various tests of the printer 40 and carriage 10 in association with instrumentation, which included high-speed movies and an Optron, Inc., electro-optical displacement follower.

The vibrations or oscillations of the various parts of the carriage 10 during the rapid stopping and starting of the carriage 10 lasts during the print time (i.e., when the character slug of the print wheel 13 strikes the platen 47 with reference to the start of the hammer fire pulse) resulting in position excursions of the carriage 10. These position excursions, from the desired position of the carriage 10 during the print time result in horizontal positioning or registration errors of the printed characters. The horizontal positioning or registration measurement determines the amount a particular printed character deviates from its desired position with respect to the printed characters positioned on either side thereof. No character deviation from its design center horizontal position by more than a predetermined amount is considered acceptable. For each selected character, one measurement will be taken. Measurements are made from reference points on all upper and lower case characters. The reference points are dependent upon the artwork for the subject character.

It was desirable to reduce the horizontal alignment error of the printed characters without performing a major and expensive redesign and beefing-up of the carriage 10 and/or the mounting thereof to the carriage mounting rails 11 and 12 and/or the size, shape or position of rails 11 and 12 themselves. The carriage oscillations, movements and vibrations were reduced by the provision of the carriage stabilization means of the present invention.

With reference to FIGS. 2-5, one embodiment of the carriage stabilization means comprises at least two support or brace members 60 and 70 with one of the support members 60 and 70 being mounted on each side (left and right as viewed by the operator) of the carriage 10 and with each support member 60 and 70 being mounted to the carriage 10 at a point higher than or above the carriage pivot point of shaft 14. Support member 60 is generally rectangular in shape with a large hole or aperture 82 formed therein to reduce the mass of the member 60. Two holes 62 and 64 are formed in the support member 60 for mounting the member 60 to the carriage 10 by means of bolts 61 and 63, in conjunction with stand-offs 65 and 66, secured to the print wheel motor 23. Support member 70 is generally a mirror image of member 60 and is mounted to the opposite side of the carriage 10 from that of member 60 by means of bolts 71 and 73 through holes 72 and 74, in conjunction with stand-offs 75 and 76. Support member 70 is generally rectangular in shape with a large hole or aperture 84 formed therein to reduce the mass of the member 70. Both support members 60 and 70 include a lower extension 67 and 77, which projects downwardly toward carriage mounting rail 11. Lower extensions 67 and 77 include right-angle extensions 68 and 78, which project outwardly from carriage 10 and lie in a plane parallel to a plane formed by a horizontal tangent to the carriage mounting rail 11. Attached to right-angle extensions 68 and 78, by staking, adhesion, etc., is a mating slide member 69 and 79 fabricated of teflon impregnated "Delrin" resin (DELRIN AF), which contacts the carriage mounting rail 11 and maintains sliding contact with rail 11 during the lateral movement of carriage 10 along rails 11 and 12. Slide members 69 and 79 could be fabricated of any material, which provides an amount of friction and drag which does not affect the operating speed of the printer 40. The preferred material noted supra does not affect the operating speed.

It is to be noted that stand-offs 65, 66, 75 and 76 are used in the mounting means for support members 60 and 70 to allow members 60 and 70 to be of a form allowing ease of fabrication. Support members 60 and 70 could be formed of a shape, which would eliminate the stand-offs 65, 66, 75 and 76 and allow members 60 and 70 to be attached directly to the print wheel motor 23.

Support members 60 and 70 are formed of low carbon steel (case hardened) with a thickness of about 0.093 inches. The overall height of members 60 and 70 is approximately 1.3 inches with a width of approximately 1.4 inches. Support members 60 and 70 could be formed of other metals or even plastics which would provide the rigid support necessary to eliminate the undesirable carriage movements during printing time. The present support members 60 and 70 provide a tripod form of stabilizing support from the contact points of slide members 69 and 79 with the carriage mounting rail 11 through the mounting to the print wheel motor 23 to an intersecting point at the hammer-type impact printing mechanism 48 located above the print wheel motor 23, thereby reducing the carriage movement during printing caused by the high inertial forces acting upon the carriage 10.

It will be appreciated that there has been shown an illustrative arrangement for use in a print wheel impact printer to provide a reduction in horizontal alignment error of the printed characters that fully satisfies the objects, aims and advantages set forth above. While the principles of the invention have been made clear in the illustrative embodiment, it is apparent that alternatives, modifications and variations will be evident to those skilled in the art. Accordingly, it is intended to embrace all alternatives, modifications and variations as fall within the spirit and broad scope of the appended claims.

What is claimed is:

1. In a serial printer having carriage mounting means enabling lateral movement of a carriage assembly along a predetermined path, located in a first plane, the carriage assembly having a first carriage section mounted to said carriage mounting means and a second carriage section pivotally mounted to said first carriage section about a pivot line wherein said second carriage section is pivotable in a second plane substantially perpendicular to said first plane, the improvement comprising:

a first member carried by a first side of said second carriage section, a second member carried by a second and opposite side of said second carriage section, and said first and second members engaging said carriage mounting means at respective locations which are laterally spaced from each other in the direction of said predetermined path, whereby unwanted pivotal movement of said carriage assembly with respect to an axis in the second plane is reduced while enabling pivoting of the second carriage section in the second plane when desired.

2. The improvement of claim 1 wherein said first and second members include a lower portion having a right-angle extension lying in a plane parallel to said first plane and contacting the carriage mounting means.

3. The improvement of claim 2 wherein said right-angle extension has a slide member attached thereto and positioned between said right-angle extension and said carriage mounting means.

4. The improvement of claim 1 wherein said carriage mounting means include two spaced apart parallel rail members.

5. The improvement of claim 1 wherein said first and second members have an aperture formed therein for reducing the mass thereof.

* * * * *